US012139360B2

(12) United States Patent
Miyazaki

(10) Patent No.: US 12,139,360 B2
(45) Date of Patent: Nov. 12, 2024

(54) POSTPROCESSING DEVICE THAT TRANSPORTS PRECEDING RECORDING MEDIUM ON SIDETRACK, WITH FOLLOWING RECORDING MEDIUM TRANSPORTED ALONG SHEET TRANSPORT PATH STACKED ON PRECEDING ONE, TO PROCESSING TRAY, AND IMAGE FORMING SYSTEM

(71) Applicant: KYOCERA Document Solutions Inc., Osaka (JP)

(72) Inventor: Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 197 days.

(21) Appl. No.: 18/097,779

(22) Filed: Jan. 17, 2023

(65) Prior Publication Data

US 2023/0234799 A1 Jul. 27, 2023

(30) Foreign Application Priority Data

Jan. 25, 2022 (JP) ..... 2022-009434

(51) Int. Cl.
*B65H 37/04* (2006.01)
*B65H 7/02* (2006.01)
(Continued)

(52) U.S. Cl.
CPC ..... *B65H 29/60* (2013.01); *B65H 7/02* (2013.01); *B65H 31/34* (2013.01); *B65H 37/04* (2013.01);
(Continued)

(58) Field of Classification Search
CPC ..... B65H 29/60; B65H 7/02; B65H 2511/11; B65H 2513/51; B65H 2513/512; B65H 2801/27; B65H 37/04; B65H 2301/4213
See application file for complete search history.

(56) References Cited

U.S. PATENT DOCUMENTS

2005/0067777 A1* 3/2005 Ilda ..... B65H 29/60 271/303
2012/0091648 A1* 4/2012 Masunari ..... G03G 15/6538 270/58.08
2013/0147106 A1* 6/2013 Tamura ..... G03G 15/6547 270/58.07

FOREIGN PATENT DOCUMENTS

JP 2012254872 A * 12/2012
JP 2015044657 A 3/2015

* cited by examiner

*Primary Examiner* — Luis A Gonzalez
(74) *Attorney, Agent, or Firm* — IP Business Solutions, LLC

(57) ABSTRACT

A postprocessing device includes a processing tray, a first transport roller, a second transport roller, a sidetrack, a sidetrack roller, and a controller. The controller shunts a preceding recording medium to the sidetrack by rotating the sidetrack roller, determines, on a basis of a length of the preceding recording medium in a transport direction, a timing to stop the rotation of the sidetrack roller such that, when the sidetrack roller is made to start rotating at a predetermined timing to start, a leading edge of a following recording medium transported by the second transport roller becomes aligned with a leading edge of the preceding recording medium, stops the rotation of the sidetrack roller at the determined timing, and transports the preceding recording medium with the following recording medium stacked thereon, to the processing tray, by rotating the second transport roller and the sidetrack roller at the reference timing to start.

6 Claims, 12 Drawing Sheets

(51) Int. Cl.
*B65H 29/60* (2006.01)
*B65H 31/34* (2006.01)

(52) U.S. Cl.
CPC .... *B65H 2511/11* (2013.01); *B65H 2513/512* (2013.01)

POSTPROCESSING DEVICE THAT TRANSPORTS PRECEDING RECORDING MEDIUM ON SIDETRACK, WITH FOLLOWING RECORDING MEDIUM TRANSPORTED ALONG SHEET TRANSPORT PATH STACKED ON PRECEDING ONE, TO PROCESSING TRAY, AND IMAGE FORMING SYSTEM

INCORPORATION BY REFERENCE

This application claims priority to Japanese Patent Application No. 2022-009434 filed on Jan. 25, 2022, the entire contents of which are incorporated by reference herein.

BACKGROUND

The present disclosure relates to a postprocessing device and an image forming system, and in particular to a technique to cause a recording medium being transported to stand by.

With reference to a postprocessing device that performs postprocessing on a recording sheet on which an image has been formed, a technique to cause the recording sheet being transported to stand by is generally known. An example of such technique includes rolling, while stapling is performed on a preceding sheet group, a first one of the following sheet group around the surface of a shunting drum, thereby causing that sheet to stand by.

SUMMARY

The disclosure proposes further improvement of the foregoing techniques.

In an aspect, the disclosure provides a postprocessing device including a processing tray, a postprocessing unit, a sheet transport path, a first detector, a first transport roller, a second transport roller, a sidetrack, a second detector, a sidetrack roller, and a controller. The postprocessing unit performs postprocessing on a recording medium placed on the processing tray. The sheet transport path extends toward the processing tray. The first detector detects presence of the recording medium at a predetermined position on the sheet transport path. The first transport roller transports the recording medium in a predetermined transport direction at a predetermined transport speed, by rotating in a predetermined first direction. The second transport roller transports the recording medium transported by the first transport roller toward the processing tray, by rotating in the first direction. The sidetrack is provided at a position different from the sheet transport path, and extends toward the second transport roller. The second detector detects presence of the recording medium at a predetermined position on the sidetrack. The sidetrack roller transports the recording medium on the sidetrack to the second transport roller, by rotating in a predetermined forward direction. The controller controls operation of the first transport roller, the second transport roller, and the sidetrack roller. The controller shunts, when a trailing edge of a preceding recording medium comes out of the sheet transport path, the preceding recording medium to the sidetrack by causing the second transport roller to rotate in a second direction opposite to the first direction, transports the preceding recording medium on the sidetrack in a shunting direction, by causing the sidetrack roller to rotate in a reverse direction opposite to the forward direction, acquires a length of the preceding recording medium in the transport direction, on a basis of a transit time of the preceding recording medium obtained from a detection result of the first detector, and the transport speed of the preceding recording medium, determines, on a basis of the length of the preceding recording medium in the transport direction, a timing to stop the rotation of the sidetrack roller such that, when the sidetrack roller is made to start rotating at a predetermined reference timing to start based on the detection result from the first detector, a leading edge of a recording medium, following the preceding recording medium and being transported by the rotation of the second transport roller in the first direction, becomes aligned with a leading edge of the preceding recording medium, and stops the rotation of the sidetrack roller at the timing to stop determined, transports the following recording medium and the preceding recording medium on the sidetrack in an overlapping manner in a state where a leading edge of the following recording medium and a leading edge of the preceding recording medium are aligned with each other, to the processing tray with the second transport roller, by causing the second transport roller to rotate in the first direction and causing the sidetrack roller to rotate in the forward direction, at the reference timing to start.

In another aspect, the disclosure provides a postprocessing device including a processing tray, a postprocessing unit, a sheet transport path, a first detector, a first transport roller, a second transport roller, a sidetrack, a second detector, a sidetrack roller, and a controller. The postprocessing unit performs postprocessing on a recording medium placed on the processing tray. The sheet transport path extends toward the processing tray. The first detector detects presence of the recording medium at a predetermined position on the sheet transport path. The first transport roller transports the recording medium in a predetermined transport direction at a predetermined transport speed, by rotating in a predetermined first direction. The second transport roller transports the recording medium transported by the first transport roller toward the processing tray, by rotating in the first direction. The sidetrack is provided at a position different from the sheet transport path, and extends toward the second transport roller. The second detector detects presence of the recording medium at a predetermined position on the sidetrack. The sidetrack roller transports the recording medium on the sidetrack to the second transport roller, by rotating in a predetermined forward direction. The controller controls operation of the first transport roller, the second transport roller, and the sidetrack roller. The controller shunts, when a trailing edge of a preceding recording medium comes out of the sheet transport path, the preceding recording medium to the sidetrack by causing the second transport roller to rotate in a second direction opposite to the first direction, transports the preceding recording medium on the sidetrack in a shunting direction, by causing the sidetrack roller to rotate in a reverse direction opposite to the forward direction, stops the rotation of the sidetrack roller at a predetermined reference timing to stop based on a detection result from the second detector, acquires a length of the preceding recording medium in the transport direction, on a basis of a transit time of the preceding recording medium obtained from a detection result of the first detector, and the transport speed of the preceding recording medium, determines, on a basis of the length of the preceding recording medium in the transport direction, a timing to start the rotation of the sidetrack roller such that, when the sidetrack roller is made to stop rotating at the reference timing to stop, a leading edge of a recording medium, following the preceding recording medium and being transported by the rotation of the second transport roller in the first direction, becomes aligned with a leading edge of the preceding recording medium, and transports the following recording medium and the preceding recording medium on the sidetrack in an overlapping manner in a state where a leading edge of the following recording medium and a leading edge of the preceding recording medium are aligned with each other, to the processing tray with the second transport roller, by causing the second transport roller to rotate in the first direction and causing the sidetrack roller to rotate in the forward direction, at the timing to start determined.

DETAILED DESCRIPTION

First Embodiment

Figure 1:
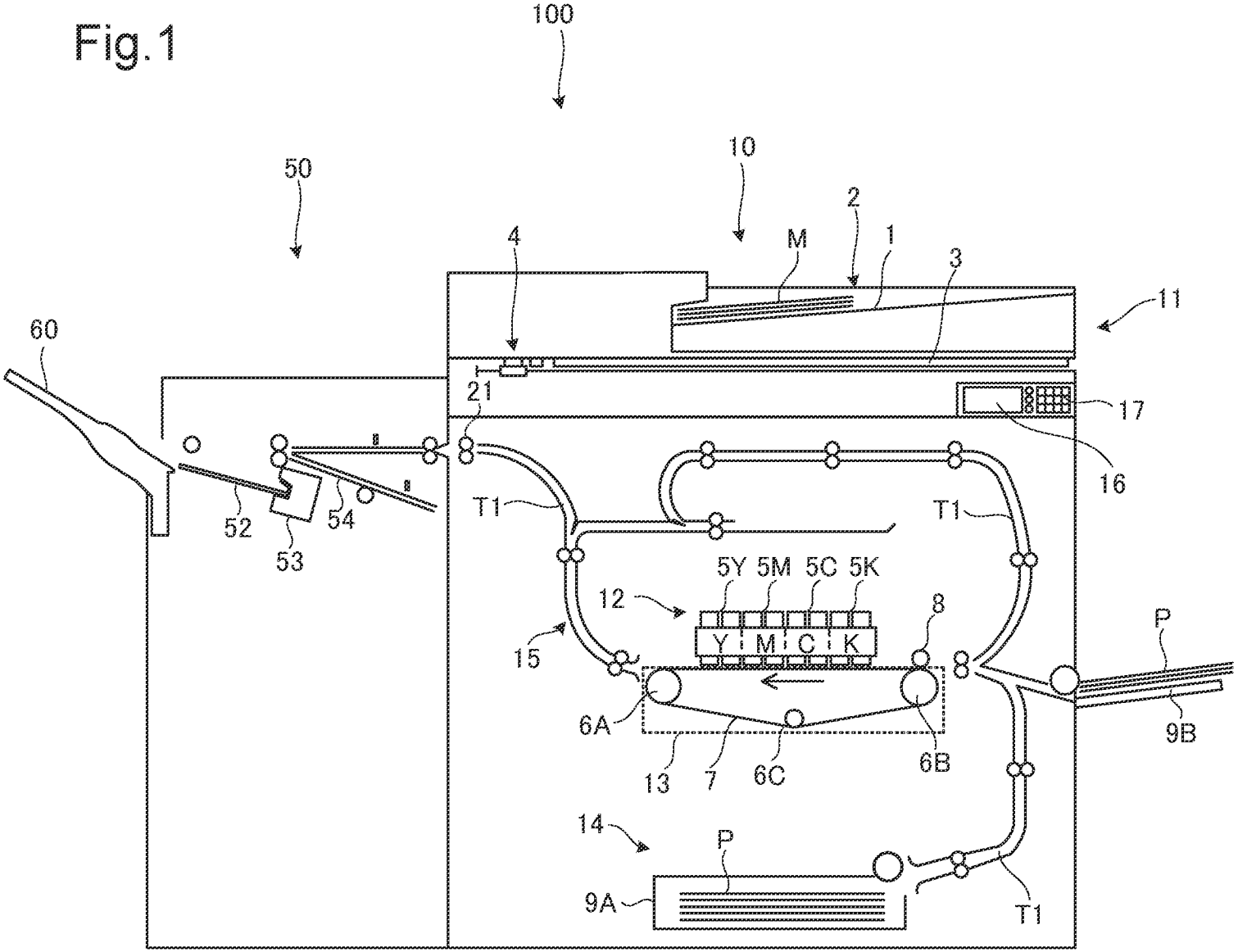
FIG. 1 is a cross-sectional view showing a structure of an image forming apparatus and a postprocessing device, constituting an image forming system.
Figure 2:
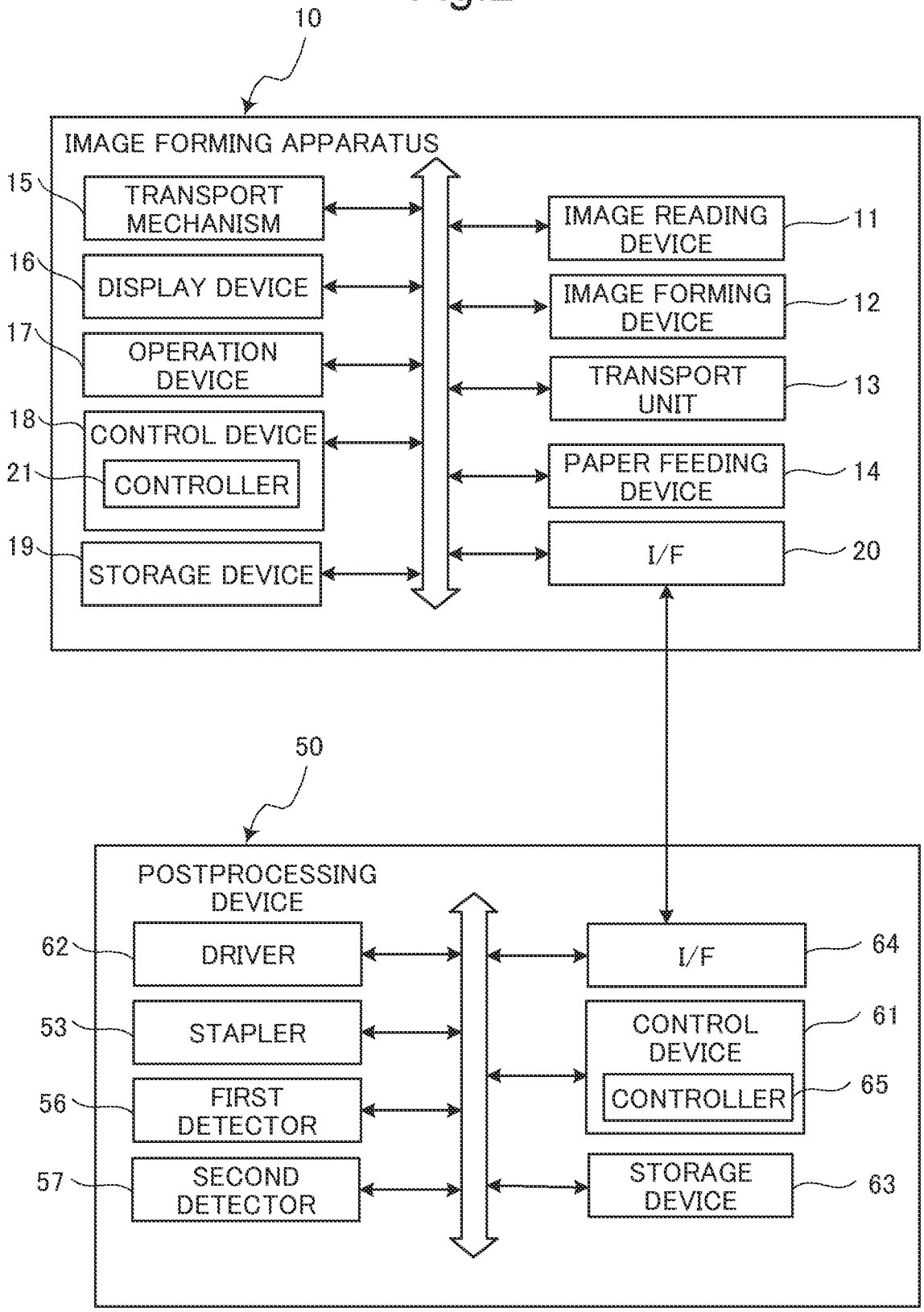
FIG. 2 is a block diagram showing an internal configuration of the image forming apparatus and the postprocessing device.

Hereunder, a first embodiment of the disclosure will be described, with reference to the drawings. FIG. 1 is a cross-sectional view showing a structure of an image forming apparatus 10 and a postprocessing device 50, constituting an image forming system 100 according to the first embodiment of the disclosure. FIG. 2 is a block diagram showing an internal configuration of the image forming apparatus 10 and the postprocessing device 50.

As shown in FIG. 1, the image forming system 100 includes the image forming apparatus 10, and the postprocessing device 50 connected to the image forming apparatus 10. The image forming apparatus 10 forms an image on a recording sheet, an example of the recording medium in the disclosure. The postprocessing device 50 performs postprocessing, on the recording sheet on which the image has been formed by the image forming apparatus 10.

[Configuration of Image Forming Apparatus 10]

As shown in FIG. 1, the image forming apparatus 10 is an ink jet recording apparatus. The image forming apparatus 10 includes an image reading device 11, an image forming device 12, a transport unit 13, a paper feeding device 14, a transport mechanism 15, a display device 16, and an operation device 17.

The image reading device 11 is constituted as an automatic document feeder (ADF), including a document feeding device 2 that transports a source document M placed on a document tray 1, and a scanner 4 that optically reads the source document M transported by the document feeding device 2, or placed on a platen glass 3. The image reading device 11 emits light to the source document from a light emitter of the scanner 4, and receives the reflected light with a charge-coupled device (CCD) sensor, to thereby read the source document and generate image data representing the source image.

The image forming device 12 includes line heads 5Y, 5M, 5C, and 5K, respectively corresponding to yellow, magenta, cyan, and black colors. The image forming device 12 ejects ink droplets of the respective colors from the line heads 5Y, 5M, 5C, and 5K, onto a recording sheet P transported by the transport unit 13, according to the image data generated by the image reading device 11, thereby forming a color image.

The transport unit 13 includes a drive roller 6A, a follower roller 6B, a tension roller 6C, a transport belt 7, and an adsorption roller 8. The drive roller 6A is connected to a drive motor, to be driven to rotate counterclockwise. The transport belt 7 is an endless belt engaged over the drive roller 6A, the follower roller 6B, and the tension roller 6C.

The transport belt 7 rotates counterclockwise, so as to follow up the rotation of the drive roller 6A. The follower roller 6B and the tension roller 6C rotate counterclockwise, so as to follow up the rotation of the transport belt 7. The adsorption roller 8 is opposed to the follower roller 6B, in contact with the transport belt 7. The adsorption roller 8 electrically charges the transport belt 7, to thereby electrostatically adsorb the recording sheet P delivered from the paper feeding device 14, to the transport belt 7.

The paper feeding device 14 includes a paper cassette 9A and a manual bypass tray 9B. The paper feeding device 14 draws out the recording sheets P stored in the paper cassette 9A or the manual bypass tray 9B one by one, with a pickup roller rotated by a paper feeding motor, and delivers the recording sheet P to the sheet transport path T1.

The transport mechanism 15 includes a sheet transport path T1 extending from the paper feeding device 14 to the postprocessing device 50 via the transport unit 13, a plurality of transport roller pairs provided close to the sheet transport path T1, a delivery roller pair 21, and a transport motor. The transport mechanism 15 rotates the transport roller pairs and the delivery roller pair 21 by driving the transport motor, to transport the recording sheet P along the sheet transport path T1, and deliver the recording sheet P to the postprocessing device 50 through the delivery roller pair 21.

The display device 16 is constituted of, for example, a liquid crystal display (LCD) or an organic light-emitting diode (OLED) display. The display device 16 displays various types of screens related to the functions that the image forming apparatus 10 is configured to perform.

The operation device 17 includes a plurality of hard keys, such as a start key for instructing the start of various operations, relevant to the functions that the image forming apparatus 10 is configured to perform. The operation device 17 also includes a touch panel overlaid on the display device 16. The user can input, through the operation device 17, various types of information, such as the instruction relevant to the functions that the image forming apparatus 10 is configured to perform.

As shown in FIG. 2, the image forming apparatus 10 further includes a control device 18, a storage device 19, and an interface (I/F) 20. The control device 18 includes a processor, a random-access memory (RAM), and a read-only memory (ROM). The processor is, for example, a central processing device (CPU), a micro processing device (MPU), or an application specific integrated circuit (ASIC).

The control device 18 is electrically connected to the image reading device 11, the image forming device 12, the transport unit 13, the paper feeding device 14, the transport mechanism 15, the display device 16, the operation device 17, the storage device 19, and the I/F 20.

The control device 18 acts as a controller 21, when the processor executes a control program stored in the ROM or the storage device 19. Here, the controller 21 may be constituted in the form of a logic circuit, instead of being realized by the operation according to the control program. The controller 21 controls the operation of each component of the image forming apparatus 10.

The storage device 19 is a large-capacity memory unit such as a solid state drive (SSD) or a hard disk drive (HDD). The storage device 19 stores therein various types of data, and various control programs for realizing the basic functions of the image forming apparatus 10.

To the I/F 20, the postprocessing device 50 is connected. The I/F 20 includes a plurality of terminals for electrical connection to the postprocessing device 50.

A power source is provided for each of the components of the image forming apparatus 1, so that those components are activated with the poser from the power source.

[Configuration of Postprocessing Device 50]

Figure 3:
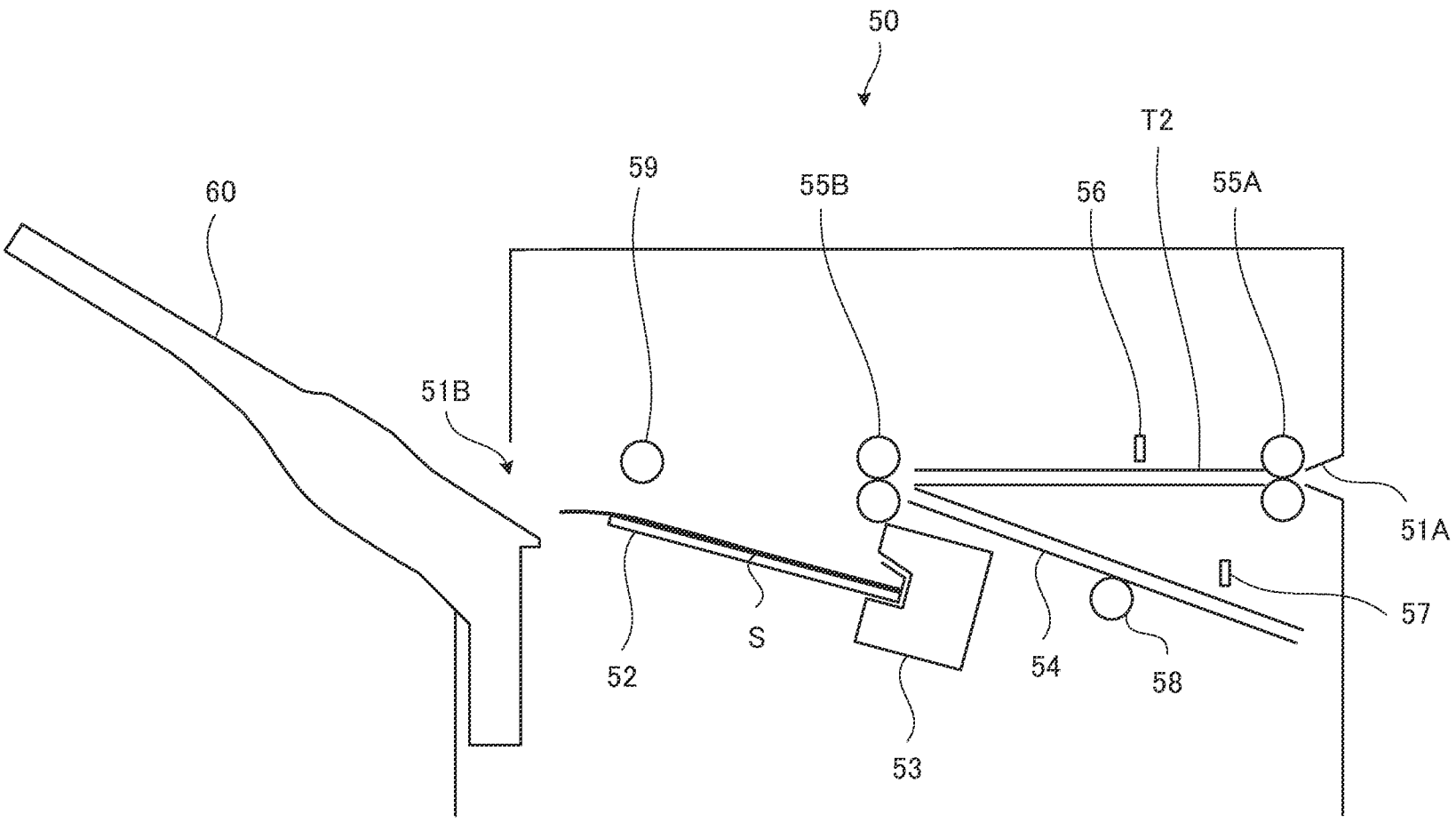
FIG. 3 is a partially enlarged cross-sectional view of the postprocessing device.

FIG. 3 is a partially enlarged cross-sectional view of the postprocessing device 50. Referring to FIG. 3, the postprocessing device 50 includes a casing, having a sheet inlet 51A formed in a first side face on the side of the image forming apparatus 10, and a delivery port 51B formed in a second side face on the opposite side of the first side face. The postprocessing device 50 includes, inside the casing, a processing tray 52, a stapler 53, a sheet transport path T2, a sidetrack 54, a first transport roller 55A, a second transport roller 55B, a first detector 56, a second detector 57, a sidetrack roller 58, a delivery roller 59, and an output tray 60.

The processing tray 52 in inclined, such that one end portion on the side of the stapler 53 is located on the lower side of the other end portion. The processing tray 52 includes a bent portion, formed so as to bend upward from the one end portion. A plurality of recording sheets P delivered to the processing tray 52 are aligned with each other, because of an end portion of each of the recording sheets P being abutted against the bent portion.

The stapler 53 performs a stapling operation as the postprocessing, including binding a bundle S of the recording sheets P placed on the processing tray 52, with a stapling needle. Here, the stapler 53 exemplifies the postprocessing unit in the disclosure.

The sheet transport path T2 extends toward the processing tray 52, from the sheet inlet 51A. The sidetrack 54 is located at a position different from the sheet transport path T2 (in this embodiment, on the lower side of the sheet transport path T2), and extends toward the second transport roller 55B.

The first transport roller 55A defines a nip region in collaboration with the follower roller. The first transport roller 55A is driven by a motor of the driver 62 so as to rotate clockwise (hereinafter, forward rotation), to thereby transport the recording sheet P transported from the image forming apparatus 10 via the sheet inlet 51A, along the sheet transport path T2 at a predetermined transport speed. Here, the clockwise direction exemplifies the first direction and the reverse direction in the disclosure.

The second transport roller 55B defines a nip region in collaboration with the follower roller. The second transport roller 55B is driven by a motor of the driver 62 so as to rotate forward, to thereby transport the recording sheet P delivered from the first transport roller 55A, toward the processing tray 52. The second transport roller 55B is also driven by the motor of the driver 62 so as to rotate counterclockwise (hereinafter, reverse rotation), to thereby cause the recording sheet P delivered from the first transport roller 55A to move backward, and enter into the sidetrack 54. Here, the counterclockwise direction exemplifies the second direction and the forward direction in the disclosure.

The first detector 56 is provided close to the sheet transport path T2. The first detector 56 detects whether the recording sheet P is present, at a predetermined position on the sheet transport path T2. The second detector 57 is provided close to the sidetrack 54. The second detector 57 detects whether the recording sheet P is present, at a predetermined position on the sidetrack 54.

The type of the first detector 56 and the second detector 57 is not specifically limited but, for example, a reflective photosensor or a transmissive photosensor may be employed. The first detector 56 and the second detector 57 each output an ON signal upon detecting the presence of the recording sheet P, and output an OFF signal when the presence of the recording sheet P is undetected.

The sidetrack roller 58 is provided on the sidetrack 54, so as to make contact with the recording sheet P. The sidetrack roller 58 is driven by a motor of the driver 62 so as to rotate forward, to thereby move the recording sheet P on the sidetrack 54 in the direction away from the second transport roller 55B, toward the second detector 57 (hereinafter, shunting direction). The sidetrack roller 58 is also driven by the motor of the driver 62 so as to rotate reversely, to thereby deliver the recording sheet P on the sidetrack 54, to the second transport roller 55B.

In this embodiment, a first stop position for locating the leading edge of the recording sheet P of A4 size in the shunting direction, and a second stop position for locating the trailing edge of the recording sheet P in the shunting direction, are defined in advance on the sidetrack 54. The second detector 57 is located at the position corresponding to the first stop position.

The delivery roller 59 is provided on the upper side of the processing tray 52. The delivery roller 59 can be elevated and lowered, by an elevation device. One end portion of the output tray 60 is located on the lower side of the delivery port 51B on the second side face of the casing. The delivery roller 59 is driven by the motor of the driver 62 so as to rotate forward, in contact with the bundle S of the recording sheets P on the processing tray 52, to thereby deliver the bundle S of the recording sheets P to the output tray 60, through the delivery port 51B.

As shown in FIG. 2, the postprocessing device 50 further includes a control device 61, a driver 62, a storage device 63, and an I/F 64. The control device 61 includes a processor, a RAM, and a ROM. The processor is, for example, a CPU, an MPU, or an ASIC. The control device 61 is electrically connected to the driver 62, the storage device 63, the I/F 64, the stapler 53, the first detector 56, and the second detector 57.

The control device 61 acts as a controller 65, when the processor executes a control program stored in the ROM or the storage device 63. Here, the controller 65 may be constituted in the form of a logic circuit, instead of being realized by the operation according to the control program. The controller 65 controls the operation of each component of the postprocessing device 50.

The driver 62 includes a plurality of motors, respectively connected to the first transport roller 55A, the second transport roller 55B, the sidetrack roller 58, and the delivery roller 59. The driver 62 causes the first transport roller 55A, the second transport roller 55B, the sidetrack roller 58, and the delivery roller 59 to rotate, by driving the corresponding motors.

The storage device 63 is a large-capacity memory unit such as a solid state drive (SSD) or a hard disk drive (HDD). The storage device 63 stores therein various types of data, and various control programs for realizing the basic functions of the postprocessing device 50. As an example of the control programs, the storage device 63 contains a first program for executing a first recording sheet shunting process according to the first embodiment.

The controller 65 performs the first recording sheet shunting process as follows, by operating according to the first program. When the trailing edge of a preceding recording sheet P1 comes out of the sheet transport path T2, the controller shunts the preceding recording sheet P1 to the sidetrack 54, by causing the second transport roller 55B to rotate reversely; transports the preceding recording sheet P1 on the sidetrack 54 in the shunting direction X2, by causing the sidetrack roller 58 to rotate forward; acquires the length of the preceding recording sheet P1 in the transport direction X1, on the basis of a transit time of the preceding recording sheet P1 obtained from the detection result of the first detector 56, and the transport speed of the preceding recording sheet P1; determines, on the basis of the length of the preceding recording sheet P1 in the transport direction X1, a timing to stop the rotation of the sidetrack roller 58 such that, when the sidetrack roller 58 is made to start rotating at a predetermined reference timing to start based on the detection result from the first detector 56, the leading edge of a recording sheet P2, following the preceding recording sheet P1 being transported by the forward rotation of the second transport roller 55B, becomes aligned with the leading edge of the preceding recording sheet P1, and stops the forward rotation of the sidetrack roller 58 at the timing to stop determined; and transports the following recording sheet P2 and the preceding recording sheet P1 on the sidetrack 54 in an overlapping manner, to the processing tray 52 with the second transport roller 55B, by causing the second transport roller 55B to rotate forward and causing the sidetrack roller 58 to rotate reversely at the reference timing to start.

To the I/F 64, the image forming apparatus 10 is connected. The I/F 64 includes a plurality of terminals for electrical connection to the image forming apparatus 10.

A power source is provided for each of the components of the postprocessing device 50, so that those components are activated with the poser from the power source.

[Operation]

Figure 4A:
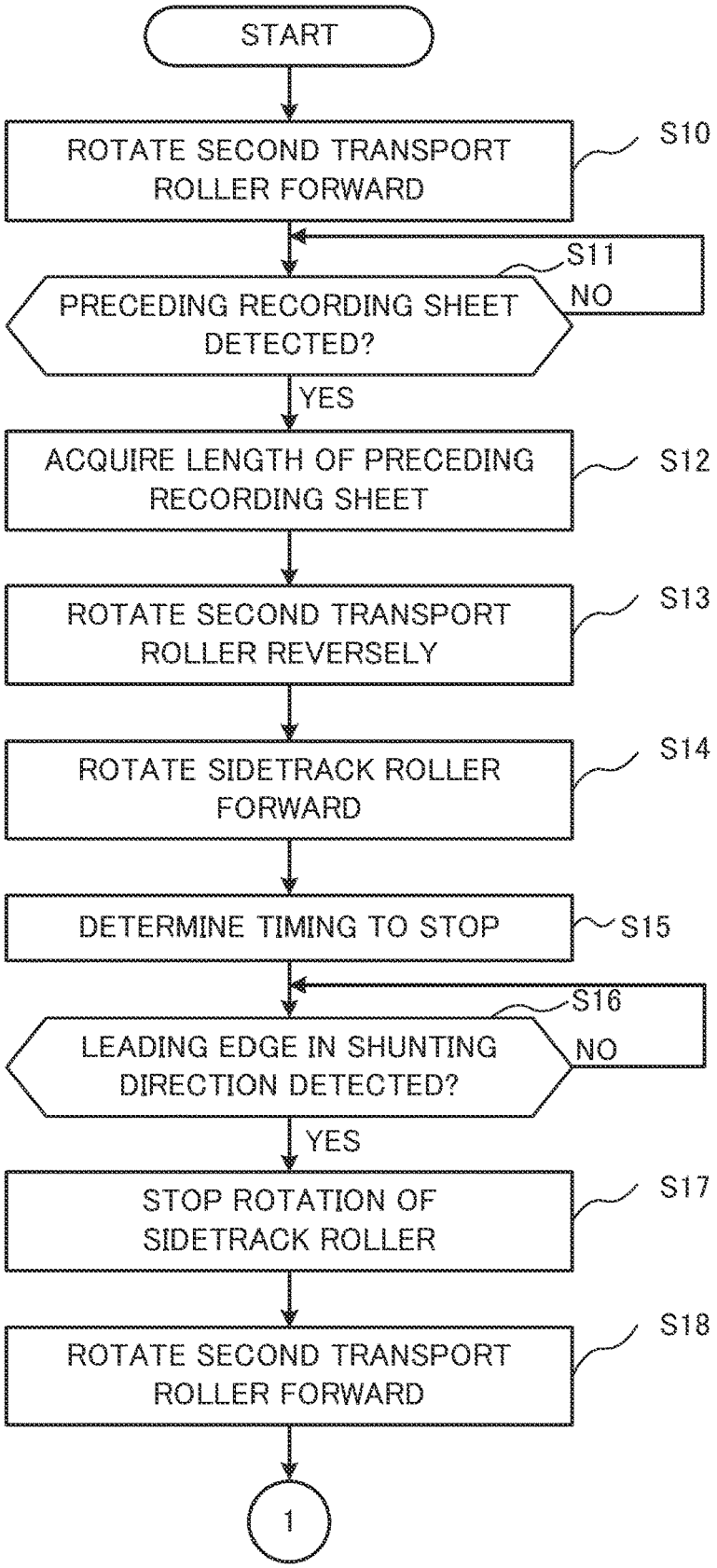
FIG. 4A and FIG. 4B are flowcharts each showing a first recording sheet shunting process.
Figure 4B:
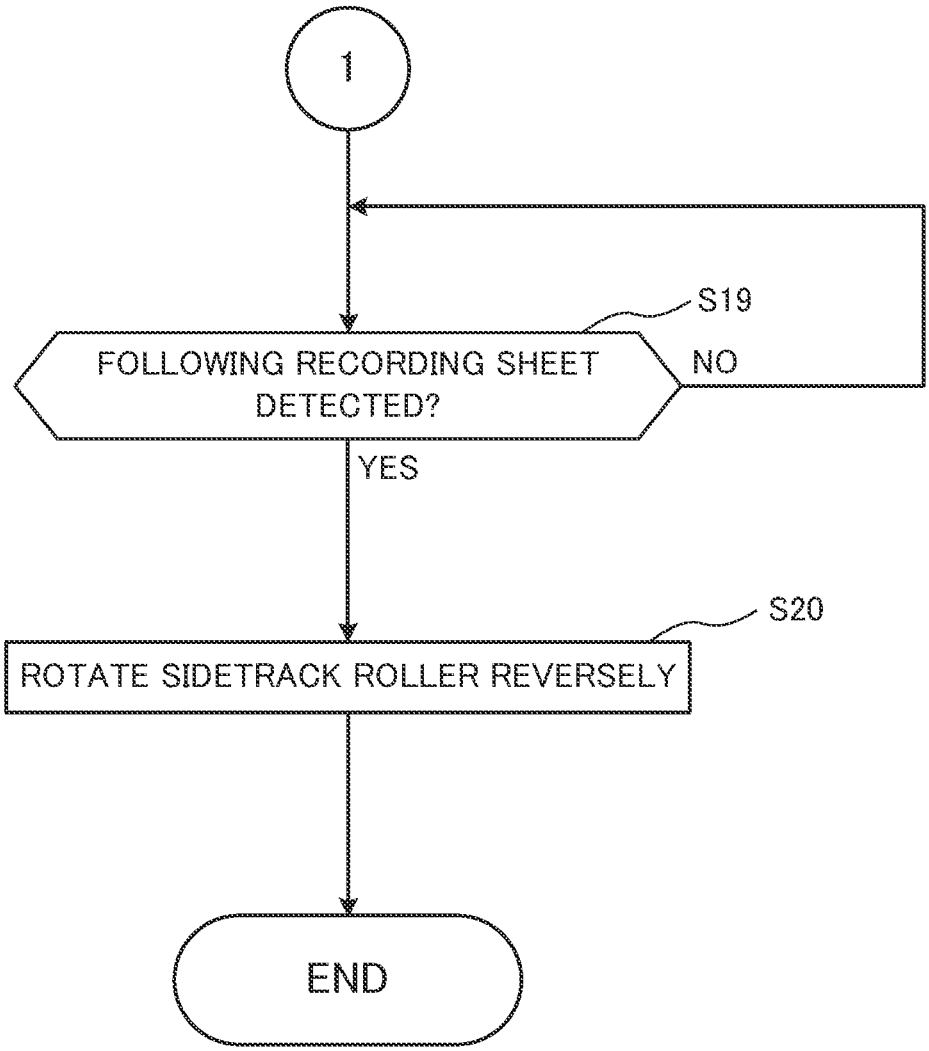
Figure 5A:
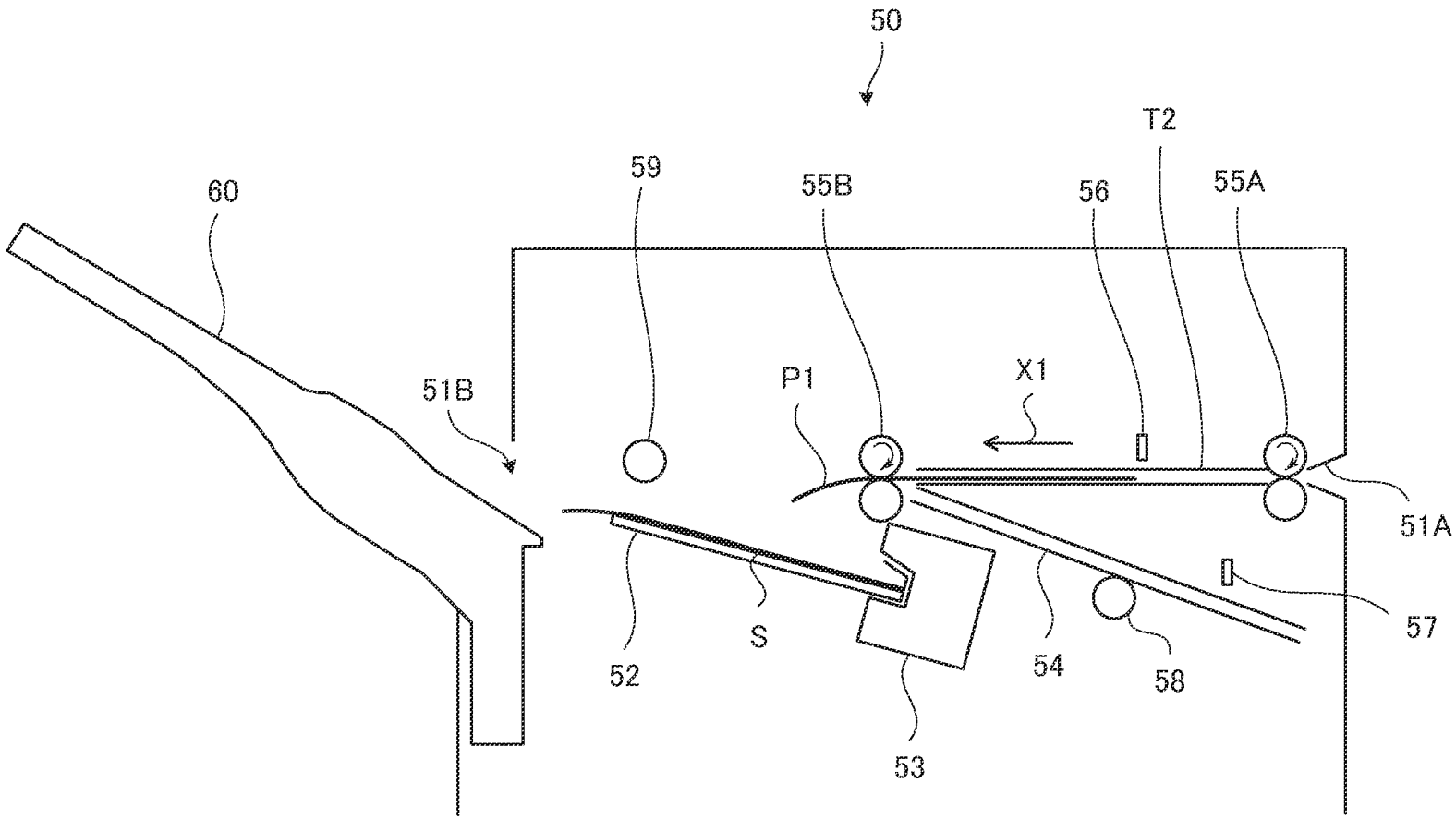
FIG. 5A to FIG. 5C are cross-sectional views each showing how a preceding recording sheet is transported.
Figure 5B:
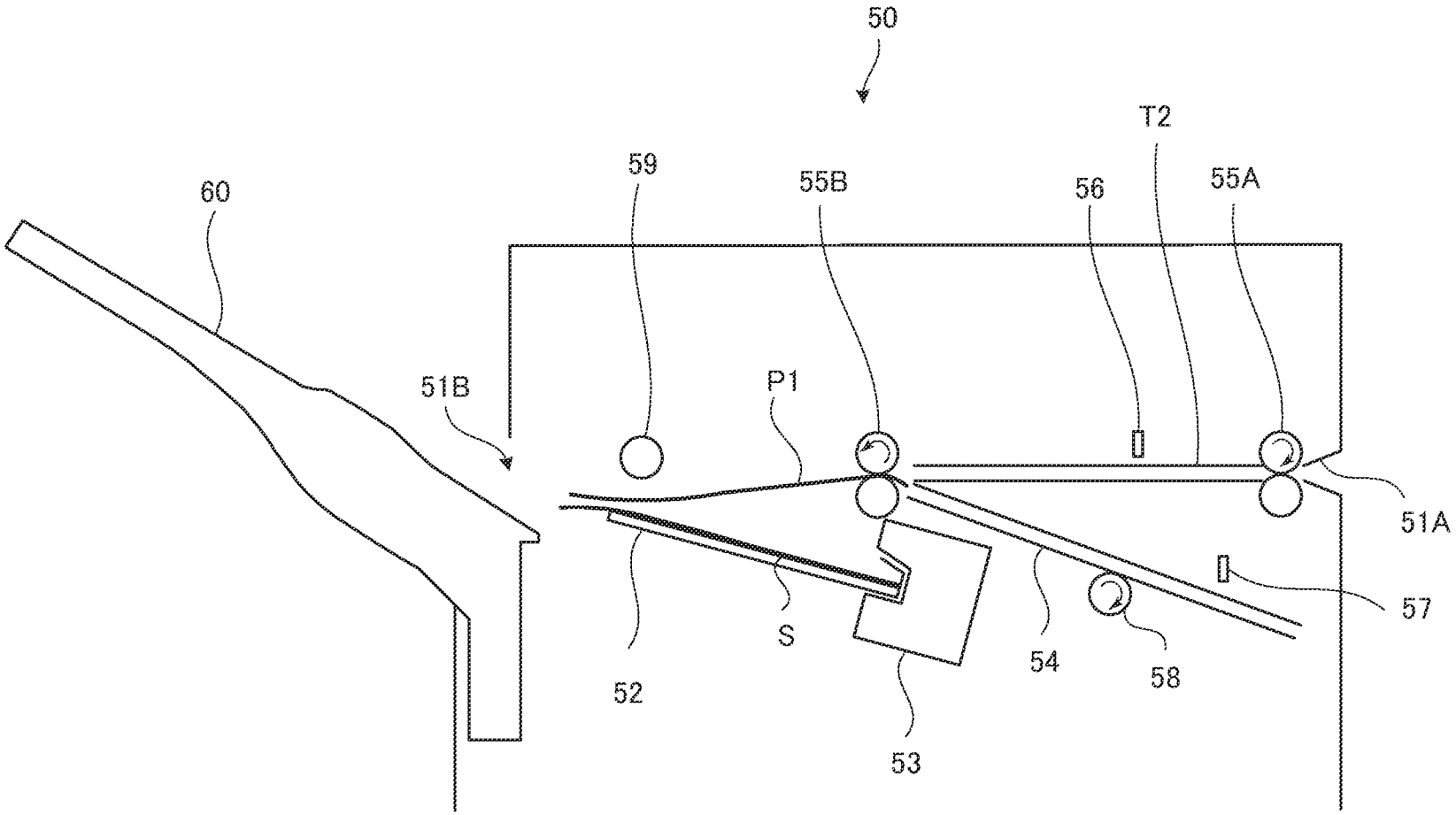
Figure 5C:
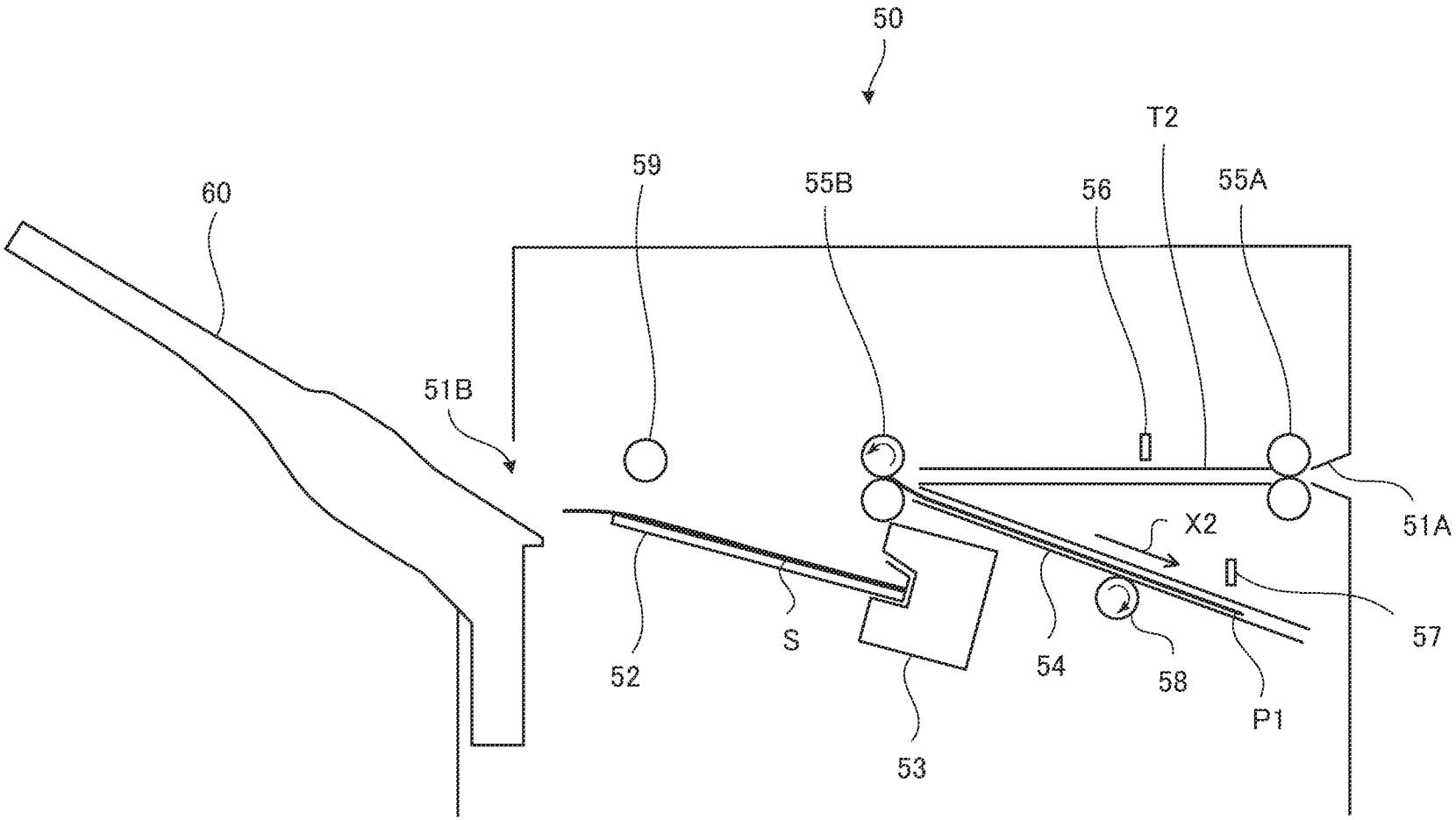
Figure 5D:
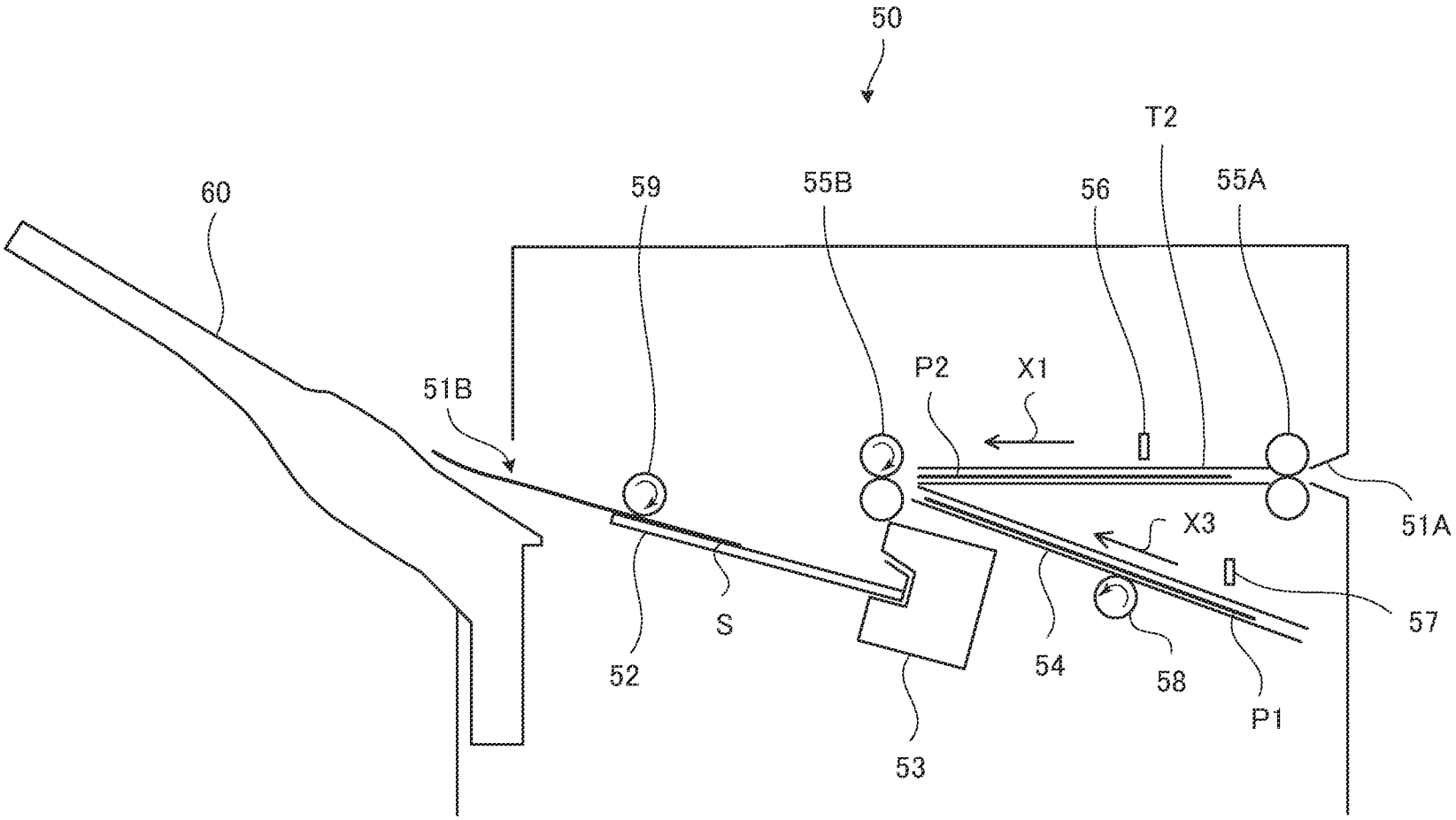
FIG. 5D and FIG. 5E are cross-sectional views each showing how the preceding recording sheet and a following recording sheet are transported.
Figure 5E:
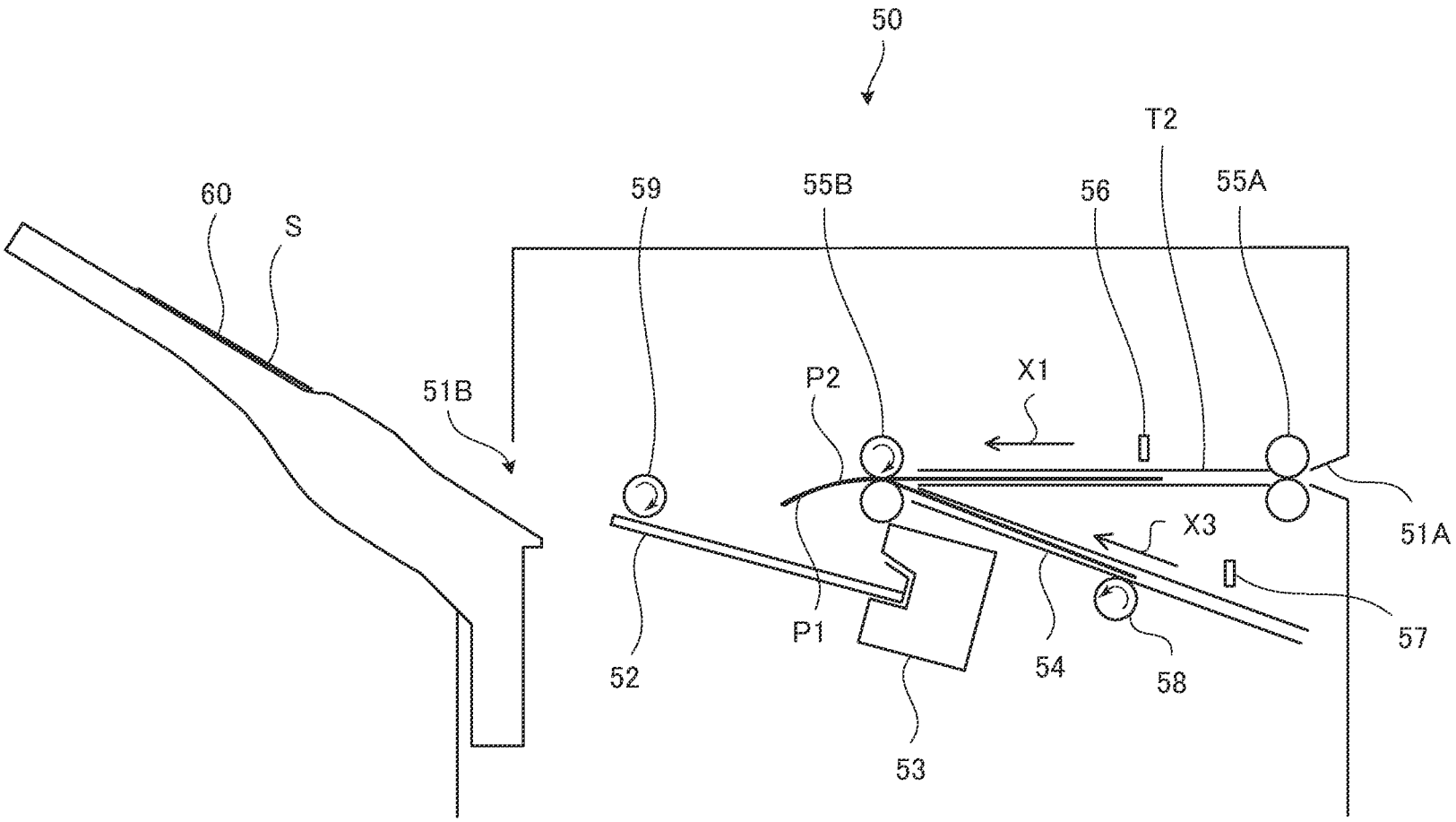

FIG. 4A and FIG. 4B are flowcharts each showing the first recording sheet shunting process. FIG. 5A illustrates how the preceding recording sheet P1 is transported. FIG. 5B and FIG. 5C each illustrate how the preceding recording sheet P1 is shunted. FIG. 5D and FIG. 5E each illustrate how the preceding recording sheet P1 and the following recording sheet P2 are transported.

Referring to FIG. 4A to FIG. 5E, an operation of the image forming system 100, performed when executing the first recording sheet shunting process, will be described hereunder. In this embodiment, it will be assumed that the length of the preceding recording sheet P1 in the transport direction X1 is equal to or longer than 297 mm.

[Operation of Image Forming Apparatus 10]

For example, the user places two sheets of the source document M on the document tray 1 of the document transport device 2. Then the user inputs, through the touch panel of the operation device 17, a first instruction to produce two copies from one source document M, and a second instruction to perform the stapling on every two sheets, and presses the start key of the operation device 17. In this case, the controller 21 of the image forming apparatus 10 transmits, upon detecting that the start key has been pressed, a control signal representing the second instruction to the postprocessing device 50, via the I/F 20.

The controller 21 also causes the image reading device 11 to read the source documents M, sequentially transported by the document transport device 2 one by one, and generate the image data representing the source image of two pages. The controller 21 then causes the transport mechanism 15 to sequentially transport four sheets of the recording sheet P toward the postprocessing device 50 along the sheet transport path T1, and causes the image forming device 12 to repeatedly form the source images of two pages represented by the image data generated as above, in the order of the pages, on the four recording sheets P transported by the transport mechanism 15.

[Operation of Postprocessing Device 50]

Upon receipt of the control signal via the I/F 64, the controller 65 of the postprocessing device 50 controls the driver 62 so as to cause the first transport roller 55A and the second transport roller 55B to rotate forward. When two recording sheets P, namely the first sheet and the second sheet are sequentially delivered from the image forming apparatus 10 through the sheet inlet 51A, these two recording sheets P are sequentially transported in the transport direction X1 along the sheet transport path T2, by the forward rotation of the first transport roller 55A and the second transport roller 55B.

The two recording sheets P each drop, when the trailing edge thereof in the transport direction X1 passes the second transport roller 55B, onto the processing tray 52 because of the gravity. The two recording sheets P each slide downward along the slope of the processing tray 52, and stop when an end portion is abutted against the bent portion of the processing tray 52. When the number of recording sheets P indicated by the second instruction (in this case, two recording sheets P) are delivered to the processing tray 52, the controller 65 instructs the stapler 53 to execute the stapling, on the bundle S of the two recording sheets P placed on the processing tray 52, and starts to execute the first recording sheet shunting process shown in FIG. 4A and FIG. 4B.

In the first recording sheet shunting process, first the controller 65 controls the driver 62, so as to cause the first transport roller 55A and the second transport roller 55B to rotate forward (step S10). Accordingly, the controller 65 transports, as shown in FIG. 5A, the preceding recording sheet P1, namely the third sheet, delivered from the image forming apparatus 10 via the sheet inlet 51A, in the transport direction X1 along the sheet transport path T2, at a predetermined transport speed.

After step S10, the controller 65 repeatedly decides that the preceding recording sheet P1 has not been detected (NO at step S11), until the first detector 56 detects the preceding recording sheet P1. When the preceding recording sheet P1 passes by the first detector 56, the first detector 56 outputs the ON signal and the OFF signal to the controller 65, so that the controller 65 decides that the preceding recording sheet P1 has been detected (YES at step S11), and acquires the length of the preceding recording sheet P1 in the transport direction X1, on the basis of the transit time of the preceding recording sheet P1 obtained from the detection result of the first detector 56, and the transport speed of the preceding recording sheet P1 (step S12).

To be more specific, the controller 65 acquires the length of the preceding recording sheet P1 in the transport direction X1, by multiplying the time between the input of the ON signal and the input of the OFF signal to the controller 65, by the transport speed of the preceding recording sheet P1. After step S12, the controller 65 controls the driver 62, so as to cause the second transport roller 55B to rotate reversely, after the trailing edge of the preceding recording sheet P1 in the transport direction X1 comes out of the sheet transport path T2, and immediately before the trailing edge passes through the second transport roller 55B, as shown in FIG. 5B (step S13). With such operation, the controller 65 shunts the preceding recording sheet P1 to the sidetrack 54.

After step S13, the controller 65 controls the driver 62 so as to cause the sidetrack roller 58 to rotate forward, as shown in FIG. 5C (step S14). Accordingly, the controller 65 transports the preceding recording sheet P1 on the sidetrack 54, in the shunting direction X2. After step S14, the controller 65 determines, on the basis of the length of the preceding recording sheet P1 in the transport direction X1, the timing to stop the forward rotation of the sidetrack roller 58, such that, when the sidetrack roller 58 is made to start rotating at the reference timing to start, the leading edge of the following recording sheet P2, transported by the forward rotation of the second transport roller 55B, becomes aligned with the leading edge of the preceding recording sheet P1 (step S15).

Here, it will be assumed that the controller 65 defines in advance the time point that the second detector 57 has detected the leading edge of the preceding recording sheet P1 in the shunting direction X2, as the reference timing to stop based on the recording sheet P of the A4 size. At step S15, to be more specific, the controller 65 decides whether the length of the preceding recording sheet P1 in the transport direction X1 exceeds a predetermined reference length (in this case, 297 mm). Upon deciding that the length of the preceding recording sheet P1 in the transport direction X1 is equal to the predetermined reference length (i.e., preceding recording sheet P1 is of A4 size), the controller 65 sets the timing to stop the sidetrack roller 58, to the reference timing to stop.

In contrast, upon deciding that the length of the preceding recording sheet P1 in the transport direction X1 exceeds the reference length, the controller 65 calculates the difference between the length of the preceding recording sheet P1 in the transport direction X1 and the reference length. Then the controller 65 sets the timing to stop the sidetrack roller 58, to the time point delayed from the reference timing to stop, by a time obtained by dividing the calculated difference by the moving speed of the preceding recording sheet P1 on the sidetrack 54.

After step S15, the controller 65 repeatedly decides that the leading edge of the preceding recording sheet P1 in the shunting direction X2 has not been detected (NO at step S16), until the second detector 57 detects the leading edge in the shunting direction X2. When the leading edge of the preceding recording sheet P1 in the shunting direction X2 passes the second detector 57, the second detector 57 outputs the ON signal to the controller 65, so that the controller 65 decides that the leading edge in the shunting direction X2 has been detected (YES at step S16), and controls the driver 62 so as to stop the forward rotation of the sidetrack roller 58, at the timing to stop determined as above (step S17).

As result, the preceding recording sheet P1 is placed on the sidetrack 54, with the trailing edge in the shunting direction X2 coinciding with the predetermined second stop position. After step S17, the controller 65 controls the driver 62, so as to cause the first transport roller 55A and the second transport roller 55B to rotate forward (step S18). Accordingly, the following recording sheet P2, namely the fourth sheet, delivered from the image forming apparatus 10 via the sheet inlet 51A, is transported in the transport direction X1 along the sheet transport path T2, as shown in FIG. 5D.

At this point, since the stapling has already been executed, the controller 65 controls the elevation device so as to lower the delivery roller 59 to enter into contact with the bundle S of the recording sheets P on the processing tray 52, and controls the driver 62 to cause the delivery roller 59 to rotate forward. As result, the bundle S of the recording sheets P on the processing tray 52 is delivered to the output tray 60, via the delivery port 51B.

After step S18, the controller 65 repeatedly decides that the following recording sheet P2 has not been detected (NO at step S19), until the first detector 56 detects the following recording sheet P2. When the following recording sheet P2 passes the first detector 56, the first detector 56 outputs the ON signal and the OFF signal to the controller 65, so that the controller 65 decides that the following recording sheet P2 has been detected (YES at step S19), and controls the driver 62 so as to cause the sidetrack roller 58 to rotate reversely, at the predetermined reference timing to start (step S20).

Here, it will be assumed that the controller 65 defines in advance the time point delayed by a predetermined time (in this case, 0.5 seconds) from the time point that the OFF signal has been inputted by the first detector 56 because of the passing of the following recording sheet P2, as the reference timing to start based on the recording sheet P of the A4 size.

As result of the operation of step S20, the preceding recording sheet P1 on the sidetrack 54 is moved in a direction S3 toward the second transport roller 55B, as shown in FIG. 5E. When the preceding recording sheet P1 reaches the second transport roller 55B, the preceding recording sheet P1 and the following recording sheet P2 are delivered to the processing tray 52 by the second transport roller 55B in an overlapping manner, with the respective leading edges in the transport direction X1 aligned with each other.

Now, with the aforementioned known postprocessing device, the preceding recording sheet standing by is stacked on the following recording sheet, to be transported together. Although it is preferable that the leading edge of the preceding recording sheet is aligned with the leading edge of the following recording sheet, the leading edges may fail to be aligned, when the recording sheets are different in size.

To avoid the mentioned problem, the known technique includes controlling the rotation of the shunting drum, so as to bring the leading edge of the preceding recording sheet to a predetermined position, thereby aligning the leading edge of the preceding recording sheet with the leading edge of the following recording sheet. In this case, however, the space for locating the shunting drum is required, and therefore the overall size of the device is increased.

With the configuration according to the first embodiment, in contrast, the controller 65 acquires the length of the preceding recording sheet P1 in the transport direction X1, on the basis of the transit time of the preceding recording sheet P1 obtained from the detection result of the first detector 56, and the transport speed of the preceding recording sheet P1, and determines, on the basis of the length of the preceding recording sheet P1 in the transport direction X1, the timing to stop the rotation of the sidetrack roller 58 such that, when the sidetrack roller 58 is made to start rotating at the predetermined reference timing to start, the leading edge of the following recording sheet P2 transported by the forward rotation of the second transport roller 55B, becomes aligned with the leading edge of the preceding recording sheet P1.

Therefore, the preceding recording sheet P1 and the following recording sheet P2 can be transported, with the respective leading edges aligned with each other, irrespective of the difference in length of the preceding recording sheet P1 in the transport direction X1. In addition, since the sidetrack 54 is employed to shunt the preceding recording sheet P1, the preceding recording sheet P1 can be shunted without the need to increase the size of the device, unlike the case where the shunting drum is employed.

According to the first embodiment, further, when the length of the preceding recording sheet P1 in the transport direction X1 is equal to the predetermined reference length, the controller 65 sets the timing to stop the sidetrack roller 58 to the predetermined reference timing to stop based on the detection result from the second detector 57. When the length of the preceding recording sheet P1 in the transport direction X1 exceeds the reference length, the controller 65 calculates the difference between the length of the preceding recording sheet P1 in the transport direction X1 and the reference length, and sets the timing to stop the sidetrack roller 58 to the time point delayed from the reference timing to stop by the time obtained by dividing the difference by the moving speed of the preceding recording sheet P1 on the sidetrack 54.

Thus, the timing to stop the sidetrack roller 58 is determined on the basis of the reference timing to stop corresponding to the reference length, and the moving speed of the preceding recording sheet P1, and therefore the timing to stop can be easily and accurately determined.

Second Embodiment

The image forming system 100 according to a second embodiment of the disclosure is configured similarly to the image forming system 100 according to the first embodiment, except that the storage device 63 of the postprocessing device 50 contains a second program for executing a second recording sheet shunting process, instead of the first program. The description of the same components and functions, as those of the image forming system 100 according to the first embodiment, will not be repeated.

In the second embodiment, the controller 65 of the postprocessing device 50 performs the second recording sheet shunting process as follows, by operating according to the second program. When the trailing edge of the preceding recording sheet P1 comes out of the sheet transport path T2, the controller 65 shunts the preceding recording sheet P1 to the sidetrack 54 by causing the second transport roller 55B to rotate reversely; transports the preceding recording sheet P1 on the sidetrack 54 in the shunting direction X2, by causing the sidetrack roller 58 to rotate forward; stops the rotation of the sidetrack roller 58 at a predetermined reference timing to stop based on the detection result from the second detector 57; acquires the length of the preceding recording sheet P1 in the transport direction X1, on the basis of a transit time of the preceding recording sheet P1 obtained from the detection result of the first detector 56, and the transport speed of the preceding recording sheet P1; determines, on the basis of the length of the preceding recording sheet P1 in the transport direction X1, a timing to start the rotation of the sidetrack roller 58 such that, when the sidetrack roller 58 is made to stop rotating at the reference timing to stop, the leading edge of a recording sheet P2, following the preceding recording sheet P1 being transported by the forward rotation of the second transport roller, becomes aligned with the leading edge of the preceding recording sheet P1; and transports the following recording sheet P2 and the preceding recording sheet P1 on the sidetrack 54 in an overlapping manner, to the processing tray 52 with the second transport roller 55B, by causing the second transport roller 55B to rotate forward and causing the sidetrack roller 58 to rotate reversely at the timing to start determined.

[Operation of Postprocessing Device 50]

Figure 6A:
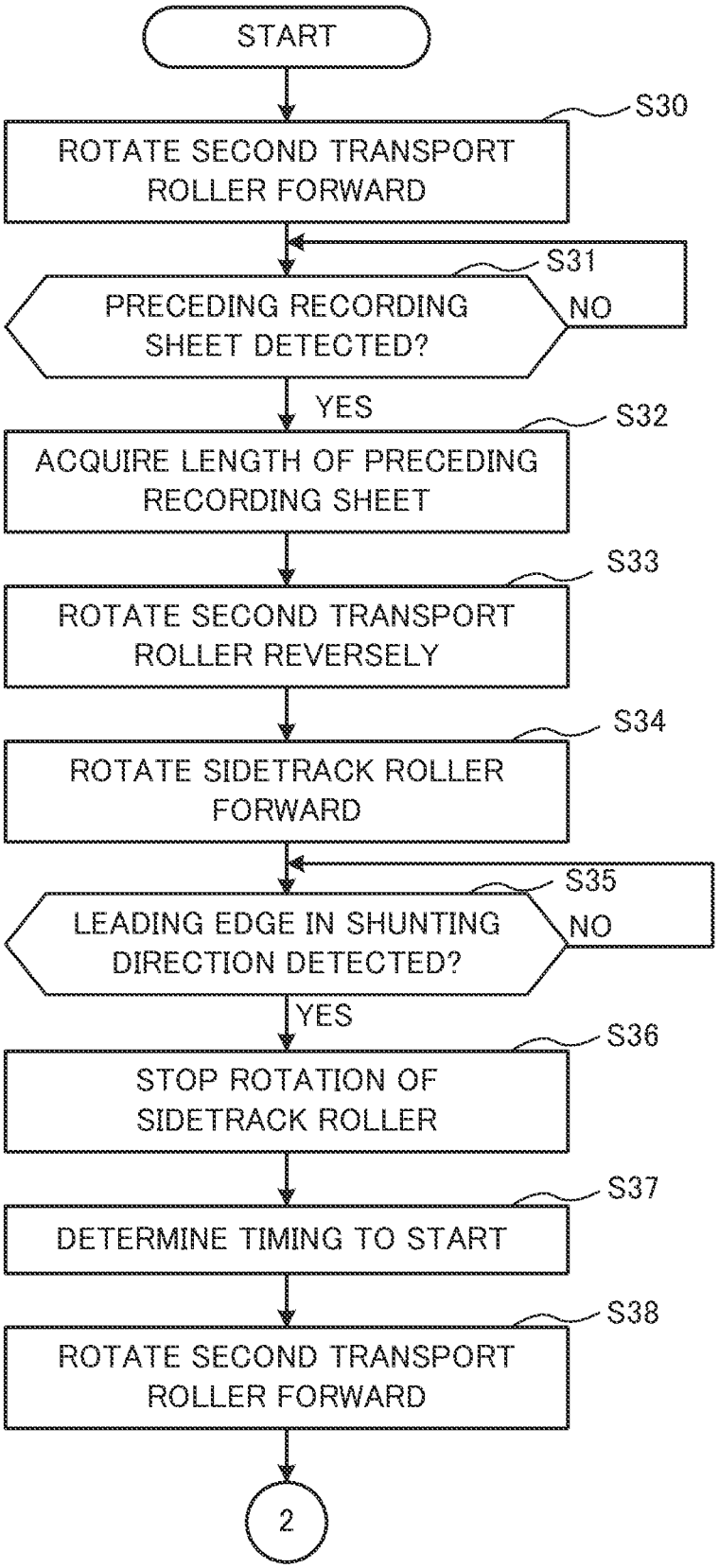
FIG. 6A and FIG. 6B are flowcharts each showing a second recording sheet shunting process.
Figure 6B:
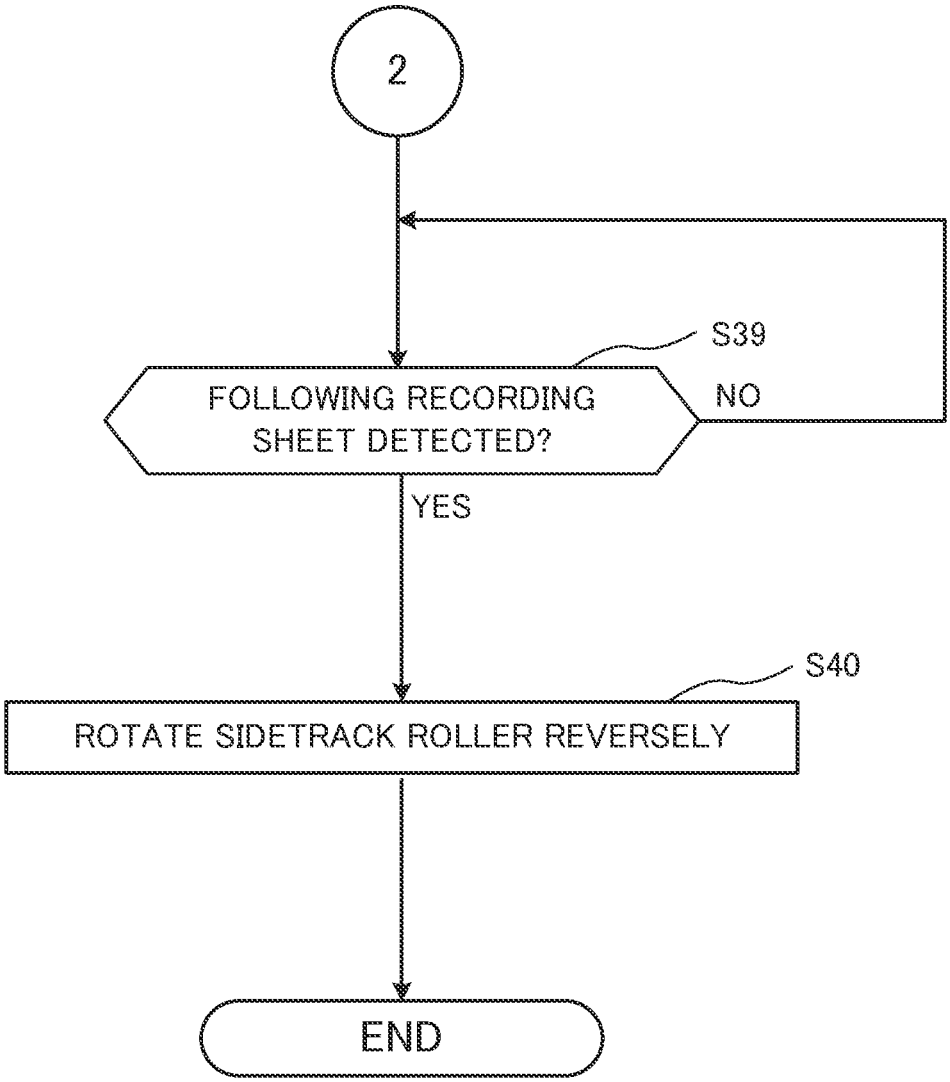

FIG. 6A and FIG. 6B are flowchart each showing the second recording sheet shunting process. Referring to FIG. 6A and FIG. 6B, an operation of the image forming system 100, performed when executing the second recording sheet shunting process, will be described hereunder. In this embodiment, it will be assumed that the length of the preceding recording sheet P1 in the transport direction X1 is equal to or longer than 297 mm.

[Operation of Postprocessing Device 50]

The controller 65 of the postprocessing device 50 starts to execute the second recording sheet shunting process shown in FIG. 6A and FIG. 6B, as in the first embodiment, upon instructing the stapler 53 to execute the stapling on the bundle S of the recording sheets P placed on the processing tray 52.

In the second recording sheet shunting process, the controller 65 performs the operation of step S30 to step S34, similarly to step S10 to step S14 of the first recording sheet shunting process. After step S34, the controller 65 repeatedly decides that the leading edge of the preceding recording sheet P1 in the shunting direction X2 has not been detected (NO at step S35), until the second detector 57 detects the leading edge in the shunting direction X2.

When the leading edge of the preceding recording sheet P1 in the shunting direction X2 passes the second detector 57, the second detector 57 outputs the ON signal to the controller 65, so that the controller 65 decides that the leading edge in the shunting direction X2 has been detected (YES at step S35), and controls the driver 62 so as to stop the forward rotation of the sidetrack roller 58, at the reference timing to stop (step S36). Here, it will be assumed that the controller 65 defines in advance the time point that the second detector 57 has detected the leading edge of the preceding recording sheet P1 in the shunting direction X2, as the reference timing to stop based on the recording sheet P of the A4 size. As result, the preceding recording sheet P1 is placed on the sidetrack 54, with the leading edge in the shunting direction X2 coinciding with the predetermined first stop position.

After step S36, the controller 65 determines, on the basis of the length of the preceding recording sheet P1 in the transport direction X1, the timing to start the reverse rotation of the sidetrack roller 58, such that, when the sidetrack roller 58 is made to stop rotating at the reference timing to stop, the leading edge of the following recording sheet P2, transported by the forward rotation of the second transport roller 55B, becomes aligned with the leading edge of the preceding recording sheet P1 (step S37). Here, it will be assumed that the controller 65 defines in advance the time point delayed by a predetermined time (in this case, 0.5 seconds) from the time point that the OFF signal has been inputted by the first detector 56 because of the passing of the following recording sheet P2, as the reference timing to start based on the recording sheet P of the A4 size.

At step S37, to be more specific, the controller 65 decides whether the length of the preceding recording sheet P1 in the transport direction X1 exceeds the predetermined reference length (in this case, 297 mm). Upon deciding that the length of the preceding recording sheet P1 in the transport direction X1 is equal to the reference length (i.e., preceding recording sheet P1 is of A4 size), the controller 65 sets the timing to start the rotation of the sidetrack roller 58, to the reference timing to start.

In contrast, upon deciding that the length of the preceding recording sheet P1 in the transport direction X1 exceeds the reference length, the controller 65 calculates the difference between the length of the preceding recording sheet P1 in the transport direction X1 and the reference length. Then the controller 65 sets the timing to start the rotation of the sidetrack roller 58, to the time point delayed from the reference timing to start, by a time obtained by dividing the calculated difference by the moving speed of the preceding recording sheet P1 on the sidetrack 54.

After step S37, the controller 65 controls the driver 62, so as to cause the first transport roller 55A and the second transport roller 55B to rotate forward (step S38). Accordingly, the following recording sheet P2, namely the fourth sheet, delivered from the image forming apparatus 10 via the sheet inlet 51A, is transported in the transport direction X1 along the sheet transport path T2, as shown in FIG. 5D.

At this point, since the stapling has already been executed, the controller 65 controls the elevation device so as to lower the delivery roller 59 to enter into contact with the bundle S of the recording sheets P on the processing tray 52, and controls the driver 62 to cause the delivery roller 59 to rotate forward. As result, the bundle S of the recording sheets P on the processing tray 52 is delivered to the output tray 60, via the delivery port 51B.

After step S38, the controller 65 repeatedly decides that the following recording sheet P2 has not been detected (NO at step S39), until the first detector 56 detects the following recording sheet P2. When the following recording sheet P2 passes the first detector 56, the first detector 56 outputs the ON signal and the OFF signal to the controller 65, so that the controller 65 decides that the following recording sheet P2 has been detected (YES at step S39), and controls the driver 62 so as to cause the sidetrack roller 58 to rotate reversely, at the timing to start determined as above (step S40).

As result of the operation of step S40, the preceding recording sheet P1 on the sidetrack 54 is moved in the direction X3 toward the second transport roller 55B, as shown in FIG. 5E. When the preceding recording sheet P1 reaches the second transport roller 55B, the preceding recording sheet P1 and the following recording sheet P2 are delivered to the processing tray 52 by the second transport roller 55B in the overlapping manner, with the respective leading edges in the transport direction X1 aligned with each other.

According to the second embodiment, the controller 65 acquires the length of the preceding recording sheet P1 in the transport direction X1, on the basis of the transit time of the preceding recording sheet P1 obtained from the detection result of the first detector 56, and the transport speed of the preceding recording sheet P1, and determines, on the basis of the length of the preceding recording sheet P1 in the transport direction X1, the timing to start the rotation of the sidetrack roller 58 such that, when the sidetrack roller 58 is made to stop rotating at the reference timing to stop, the leading edge of the following recording sheet P2 transported by the forward rotation of the second transport roller 55B, becomes aligned with the leading edge of the preceding recording sheet P1.

Therefore, the preceding recording sheet P1 and the following recording sheet P2 can be transported, with the respective leading edges aligned with each other, irrespective of the difference in length of the preceding recording sheet P1 in the transport direction X1.

According to the second embodiment, further, when the length of the preceding recording sheet P1 in the transport direction X1 is equal to the predetermined reference length, the controller 65 sets the timing to start the rotation of the sidetrack roller 58 to the predetermined reference timing to start based on the detection result from the first detector 56. When the length of the preceding recording sheet P1 in the transport direction X1 exceeds the reference length, the controller 65 calculates the difference between the length of the preceding recording sheet P1 in the transport direction X1 and the reference length, and sets the timing to start the rotation of the sidetrack roller 58 to the time point delayed from the reference timing to start by the time obtained by dividing the difference by the moving speed of the preceding recording sheet P1 on the sidetrack 54.

Thus, the timing to start the rotation of the sidetrack roller 58 is determined on the basis of the reference timing to start corresponding to the reference length, and the moving speed of the preceding recording sheet P1, and therefore the timing to start can be easily and accurately determined.

[Other Variations]

Although the postprocessing device 50 includes the stapler 53 as the postprocessing unit in the foregoing embodiments, the disclosure is not limited to such embodiments. For example, the postprocessing device 50 may include, as the postprocessing unit, a folding device that folds the recording sheet P on the processing tray 52, or a punching device that perforates the recording sheet P on the processing tray 52.

According to the foregoing embodiments, the controller 65 starts to execute the first recording sheet shunting process or the second recording sheet shunting process, while the stapler 53 is executing the stapling. However, the disclosure is not limited to such embodiments. For example, the controller 65 may start to execute the first recording sheet shunting process or the second recording sheet shunting process, when the stapling operation is completed.

Further, although the controller 65 shunts only a single recording sheet P to the sidetrack 54 in the foregoing embodiments, the disclosure is not limited to such embodiments. For example, the controller 65 may shunt two recording sheets P to the sidetrack 54. In this case, the controller 65 may determine the timing to stop or start the rotation of the sidetrack roller 58 for the second recording sheet P, on the basis of the length of the second recording sheet P in the transport direction X1, or determine the timing to stop or start on the basis of the length of the first or second recording sheet P, whichever is longer, in the transport direction X1.

Although the image forming device 12 is configured to form an image on the recording sheet P in the foregoing embodiment, the disclosure is not limited to such embodiment. The image forming device 12 may form an image on a different recording medium, other than the recording sheet. For example, an overhead projector (OHP) sheet may be employed, to form an image.

The disclosure may be modified in various manners, without limitation to the configuration according to the foregoing embodiments. For example, although the image forming apparatus 10 is exemplified by the color multifunction peripheral in the embodiments, other types of image forming apparatus, such as a monochrome multifunction peripheral, a copier, or a facsimile machine may be employed instead. In addition, a laser-based image forming apparatus may be employed as the image forming apparatus 10, in place of the ink jet recording apparatus.

Further, the configurations and processings described in the foregoing embodiment and variations with reference to FIG. 1 to FIG. 6B are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A postprocessing device comprising:

a processing tray;

a postprocessing unit that performs postprocessing on a recording medium placed on the processing tray;

a sheet transport path extending toward the processing tray;

a first detector that detects presence of the recording medium at a predetermined position on the sheet transport path;

a first transport roller that transports, by rotating in a predetermined first direction, the recording medium in a predetermined transport direction at a predetermined transport speed;

a second transport roller that transports, by rotating in the first direction, the recording medium transported by the first transport roller toward the processing tray;

a sidetrack provided at a position different from the sheet transport path, and extending toward the second transport roller;

a second detector that detects presence of the recording medium at a predetermined position on the sidetrack;

a sidetrack roller that transports the recording medium on the sidetrack to the second transport roller, by rotating in a predetermined forward direction; and a controller that controls operation of the first transport roller, the second transport roller, and the sidetrack roller, the controller being configured to:

shunt, when a trailing edge of a preceding recording medium comes out of the sheet transport path, the preceding recording medium to the sidetrack by causing the second transport roller to rotate in a second direction opposite to the first direction;

transport the preceding recording medium on the sidetrack in a shunting direction, by causing the sidetrack roller to rotate in a reverse direction opposite to the forward direction;

acquire a length of the preceding recording medium in the transport direction, on a basis of a transit time of the preceding recording medium obtained from a detection result of the first detector, and the transport speed of the preceding recording medium;

determine, on a basis of the length of the preceding recording medium in the transport direction, a timing to stop the rotation of the sidetrack roller such that, when the sidetrack roller is made to start rotating at a predetermined reference timing to start based on the detection result from the first detector, a leading edge of a recording medium, following the preceding recording medium and being transported by the rotation of the second transport roller in the first direction, becomes aligned with a leading edge of the preceding recording medium, and stop the rotation of the sidetrack roller at the timing to stop determined; and transport the following recording medium on the sheet transport path and the preceding recording medium on the sidetrack in an overlapping manner in a state where a leading edge of the following recording medium and a leading edge of the preceding recording medium are aligned with each other, to the processing tray with the second transport roller, by causing the second transport roller to rotate in the first direction and causing the sidetrack roller to rotate in the forward direction, at the reference timing to start.

2. The postprocessing device according to claim 1, wherein the controller is configured to:

set the timing to stop to a predetermined reference timing to stop based on a detection result from the second detector, when the length of the preceding recording medium in the transport direction is equal to a predetermined reference length, and calculate, when the length in the transport direction exceeds the reference length, a difference between the length in the transport direction and the reference length, and set the timing to stop to a time point delayed from the reference timing to stop by a time obtained by dividing the difference by a moving speed of the preceding recording medium on the sidetrack.

3. A postprocessing device comprising:

a processing tray;

a postprocessing unit that performs postprocessing on a recording medium placed on the processing tray;

a sheet transport path extending toward the processing tray;

a first detector that detects presence of the recording medium at a predetermined position on the sheet transport path;

a first transport roller that transports, by rotating in a predetermined first direction the recording medium in a predetermined transport direction at a predetermined transport speed;

a second transport roller that transports, by rotating in the first direction, the recording medium transported by the first transport roller toward the processing tray;

a sidetrack provided at a position different from the sheet transport path, and extending toward the second transport roller;

a second detector that detects presence of the recording medium at a predetermined position on the sidetrack;

a sidetrack roller that transports the recording medium on the sidetrack to the second transport roller, by rotating in a predetermined forward direction; and a controller that controls operation of the first transport roller, the second transport roller, and the sidetrack roller, the controller being configured to:

shunt, when a trailing edge of a preceding recording medium comes out of the sheet transport path, the preceding recording medium to the sidetrack by causing the second transport roller to rotate in a second direction opposite to the first direction;

transport the preceding recording medium on the sidetrack in a shunting direction, by causing the sidetrack roller to rotate in a reverse direction opposite to the forward direction;

stop the rotation of the sidetrack roller at a predetermined reference timing to stop based on a detection result from the second detector;

acquire a length of the preceding recording medium in the transport direction, on a basis of a transit time of the preceding recording medium obtained from a detection result of the first detector, and the transport speed of the preceding recording medium;

determine, on a basis of the length of the preceding recording medium in the transport direction, a timing to start the rotation of the sidetrack roller such that, when the sidetrack roller is made to stop rotating at the reference timing to stop, a leading edge of a recording medium, following the preceding recording medium and being transported by the rotation of the second transport roller in the first direction, becomes aligned with a leading edge of the preceding recording medium; and transport the following recording medium on the sheet transport path and the preceding recording medium on the sidetrack in an overlapping manner in a state where a leading edge of the following recording medium and a leading edge of the preceding recording medium are aligned with each other, to the processing tray with the second transport roller, by causing the second transport roller to rotate in the first direction and causing the sidetrack roller to rotate in the forward direction, at the timing to start determined.

4. The postprocessing device according to claim 3, wherein the controller is configured to:

set the timing to start to a predetermined reference timing to start based on a detection result from the first detector, when the length of the preceding recording medium in the transport direction is equal to a predetermined reference length, and calculate, when the length in the transport direction exceeds the reference length, a difference between the length in the transport direction and the reference length, and set the timing to start to a time point delayed from the reference timing to start by a time obtained by dividing the difference by a moving speed of the preceding recording medium on the sidetrack.

5. The postprocessing device according to claim 1, wherein the sidetrack is located on a lower side of the sheet transport path.

6. An image forming system comprising:

the postprocessing device according to claim 1; and an image forming apparatus including an image forming device that forms an image on the recording medium.

* * * * *